US009587524B2

(12) United States Patent
Bayrakdar et al.

(10) Patent No.: US 9,587,524 B2
(45) Date of Patent: Mar. 7, 2017

(54) DEVICE FOR CHANGING THE RELATIVE ANGULAR POSITION OF A CAMSHAFT WITH RESPECT TO A CRANKSHAFT OF AN INTERNAL COMBUSTION ENGINE

(71) Applicants: Volkswagen AG, Wolfsburg (DE); Schaeffler Technologies AG & Co. KG, Herzogenaurach (DE)

(72) Inventors: Ali Bayrakdar, Roethenbach/Pegnitz (DE); Uwe Elfers, Lehre (DE); Thomas Mueller, Wolfsburg (DE); Holger Pieper, Wedemark (DE)

(73) Assignees: Volkswagen AG, Wolfsburg (DE); Schaeffer Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/796,258

(22) Filed: Jul. 10, 2015

(65) Prior Publication Data

US 2015/0315938 A1 Nov. 5, 2015

Related U.S. Application Data

(63) Continuation of application No. 13/636,550, filed as application No. PCT/EP2011/051802 on Feb. 8, 2011.

(30) Foreign Application Priority Data

Mar. 24, 2010 (DE) ..... 10 2010 012 482

(51) Int. Cl.
*F01L 1/34* (2006.01)
*F01L 1/344* (2006.01)

(52) U.S. Cl.
CPC ..... *F01L 1/34* (2013.01); *F01L 1/3442* (2013.01); *F01L 2001/34446* (2013.01)

(58) Field of Classification Search
CPC ..... F01L 1/3442; F01L 2001/34446
See application file for complete search history.

(56) References Cited

U.S. PATENT DOCUMENTS 5,189,999 A * 3/1993 Thoma ..... F01L 1/022 123/198 C
2005/0274344 A1* 12/2005 Auchter ..... F01L 1/3442 123/90.17

(Continued)

FOREIGN PATENT DOCUMENTS

DE 39 29 619 3/1991
DE 39 29 621 3/1991

(Continued)

*Primary Examiner* — Zelalem Eshete
(74) *Attorney, Agent, or Firm* — Davidson, Davidson & Kappel, LLC

(57) ABSTRACT

A device for changing the relative angular position of a camshaft with respect to a crankshaft of an internal combustion engine, wherein the drive element is rotatably mounted with respect to the crankshaft and is driven by the camshaft. Between the drive element and the camshaft at least two hydraulic chambers are formed, wherein the hydraulic chambers can be pressurized with a pressurized fluid in order to set a defined relative rotational position between the drive element and the camshaft. The device includes a housing element, wherein a pressure reservoir having a pressure chamber for pressurized fluid is arranged on the housing element and wherein the basic form of the pressure reservoir is substantially cylindrical. The pressure reservoir is disposed on the housing element in such a manner that the cylindrical lateral face thereof abuts a lateral portion of the housing element, wherein at least one fluid connection is formed between the housing element and the pressure chamber of the pressure reservoir.

13 Claims, 6 Drawing Sheets

(56) References Cited

U.S. PATENT DOCUMENTS

| | | | | |
|---|---|---|---|---|
| 2010/0313834 | A1 | 12/2010 | Auchter et al. | |
| 2010/0326383 | A1 | 12/2010 | Auchter et al. | |
| 2011/0139105 | A1* | 6/2011 | Watanabe | F01L 1/3442 123/90.38 |

FOREIGN PATENT DOCUMENTS

| | | | |
|---|---|---|---|
| DE | 4210580 | | 10/1993 |
| DE | 102006052998 | | 7/2008 |
| DE | 10 2007 056 683 | | 5/2009 |
| DE | 10 2007 056 685 | A1 | 5/2009 |
| DE | 10 2008 015 137 | | 10/2009 |
| EP | 2 267 282 | | 12/2010 |
| JP | 2009-167842 | | 7/2009 |

* cited by examiner

DEVICE FOR CHANGING THE RELATIVE ANGULAR POSITION OF A CAMSHAFT WITH RESPECT TO A CRANKSHAFT OF AN INTERNAL COMBUSTION ENGINE

This is a Continuation Application of U.S. patent application Ser. No. 13/636,550, filed Sep. 21, 2012 which is a National Phase Application of International Patent Application PCT/EP2011/051802, filed Feb. 8, 2011, claiming priority to German Patent Application DE 10 2010 012 482.6, filed Mar. 24, 2010, all of which are hereby incorporated by reference herein.

FIELD OF THE INVENTION

The invention relates to a device for changing the relative angular position of a camshaft with respect to a crankshaft of an internal combustion engine with a drive element driven by the crankshaft, wherein the drive element is mounted rotatable with respect to the camshaft, and wherein at least two hydraulic chambers are formed between the drive element and the camshaft. The hydraulic chambers are pressurized with a pressurized fluid in order to set a defined relative rotational position between the drive element and the camshaft. The device comprises a housing element, in which means for controlling the flow of the pressurized fluid are arranged, wherein a pressure reservoir having a pressure chamber for pressurized fluid is disposed on the housing element and wherein the basic form of the pressure reservoir is substantially cylindrical.

BACKGROUND

Camshaft adjustment devices, in particular hydraulic camshaft adjustment devices are well known in the state of the art. The hydraulic camshaft adjustment device comprises an impeller having blades molded in or arranged on. The blades are located in hydraulic chambers, which are formed in an outer rotor. By appropriately applying hydraulic fluid to the corresponding side of the hydraulic chambers an adjustment of the inner rotor (connected to the camshaft) relative to the outer rotor can be achieved between an "early stop" and a "late stop". Thereby, the flow of hydraulic fluid is controlled by means of an electrically activated directional valve. The transmission of the rotary motion of the crankshaft to the outer rotor is performed by a gearwheel mounted non-rotatably to the outer rotor.

A camshaft adjustment device of the mentioned kind is known from the German patent application DE 39 29 619 A1. The adjustment of the relative rotational position between crankshaft and camshaft is also achieved by hydraulic means. To constantly provide hydraulic fluid of sufficient pressure, a pressure reservoir with substantially cylindrical form is arranged on a cover element. The pressure reservoir radially extends away from the housing element. Through an also radially extending connection bore between the cover element and the pressure reservoir pressurized fluid can be channeled to the pressure reservoir to move a spring-biased piston by one piston stroke. The pressurized fluid then is available to the pressure reservoir with predetermined pressure. As needed, pressurized fluid can be removed again, wherein the spring moves the piston and thus fluid pressure is kept at a constant rate.

One disadvantage of the described device is that the manufacturing effort for the cover element and the pressure reservoir is relatively high and a plurality of cutting operations is usually required until completion. A further disadvantage is that the described kind of construction causes a device with relatively huge dimensions, which can't always be put into practice due to limitedly available space.

SUMMARY OF THE INVENTION

It is an object of the present invention to provide a device of the previously described kind in such a way, that a more compact construction is achieved than the already known solution. Furthermore it is focused to provide a more cost-effective manufacturing of said device.

The present invention provides that the pressure reservoir is arranged on the housing element in such a manner that the cylindrical lateral face thereof abuts a lateral portion of the housing element, wherein at least one fluid connection is formed between the housing element and the pressure chamber of the pressure reservoir.

If further additional elements abut the actual cylindrical contour of the pressure reservoir basic structure, the defined cylindrical lateral face refers to the cylindrical lateral face of the pressure reservoir's basic form.

The pressure reservoir is preferably formed as a piston-cylinder system, wherein a piston is arranged movably in a cylinder element and wherein the piston is biased in the cylinder element by a spring element, in particular a coil spring.

The housing element and the housing of the pressure reservoir are preferably formed as one piece part. The housing element and the housing of the pressure reservoir are in particular cast parts. The housing element and the housing of the pressure reservoir are made of light metal, in particular aluminum.

Between the lateral region of the housing element and the pressure chamber of the pressure reservoir a fluid connection conduct can be arranged, that runs parallel to a direction of movement of the piston of the pressure reservoir to an axial end portion of the pressure reservoir. The length of the fluid connection line is preferably 50 percent of the overall height of the pressure reservoir.

An axial end portion of the pressure reservoir can be closed by a cover element. The cover element can have at least one flow path for the flow of pressurized fluid from the end of the fluid connection line to the pressure chamber. Alternatively or additionally it is possible to form the piston in such a manner that the flow of pressurized fluid from the end of the fluid connection conduct to the pressure chamber is enabled.

The cover element can be sealed by sealing elements at the pressure reservoir basic structure. The mounting can be realized in any given form, for instance with bolts, by welding or soldering, but also by an adhesive bond.

The piston can delimit the pressure chamber of the pressure reservoir to an equalization chamber, wherein a fluid connection (vent conduct) can be formed between the housing element and the equalization chamber of the pressure reservoir. The vent conduct can also be realized by a groove in the portion of the unpressurized side of the pressure reservoir.

Finally, means for limiting the axial movement of the piston in the cylinder element can be provided. This allows the prevention of driving the previously mentioned spring element to its hard stop.

The pressure reservoir can thus be arranged on the housing element in a simple manner, wherein it is possible to exactly define the ideal position of the pressure reservoir in the specific application.

The pressure reservoir can also be arranged slightly inclined to the cover element, if the circumstances concerning the available space require so.

Furthermore, the proposed arrangement is advantageous due to its relatively low weight.

The proposed concept is particularly advantageous to be realized by means of casting. It is thus possible and preferred to manufacture the housing element and the housing of the pressure reservoir in one piece. Cutting operations can thereby be reduced to a minimum and thus costs are reduced.

The proposed concept can generally be put into practice in every system that use hydraulic systems, for which a pressurized fluid has to be provided, wherefore a pressure reservoir is used.

BRIEF DESCRIPTION OF THE DRAWINGS

In the following, an embodiment will explain the inventive device with reference to the accompanying drawings, in which.

DETAILED DESCRIPTION

Figure 1:
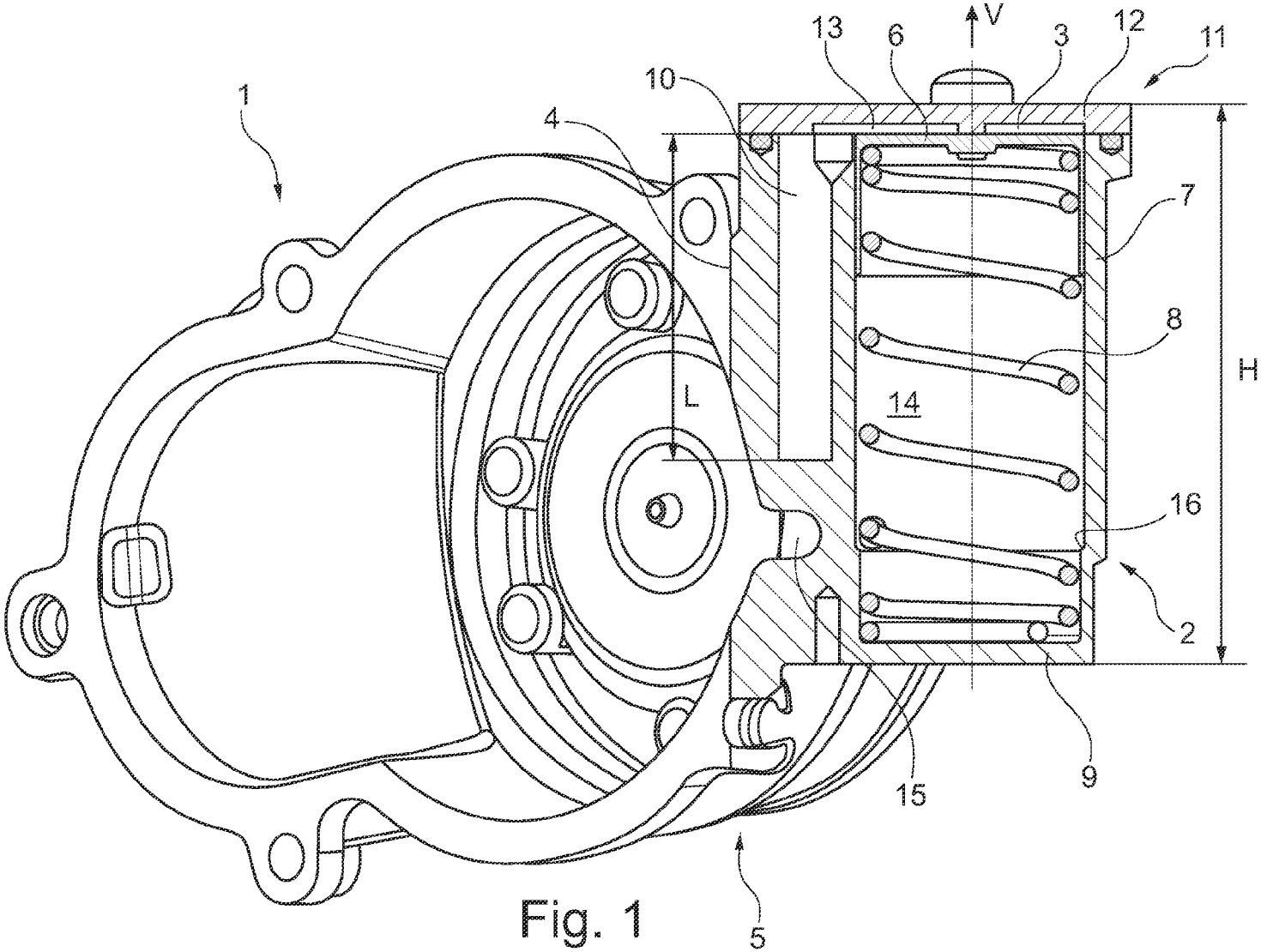
FIG. 1 shows a perspective view of a cover element of a camshaft adjustment device having a pressure reservoir integrally formed, wherein the pressure reservoir is shown as cross-sectional view.
Figure 2:
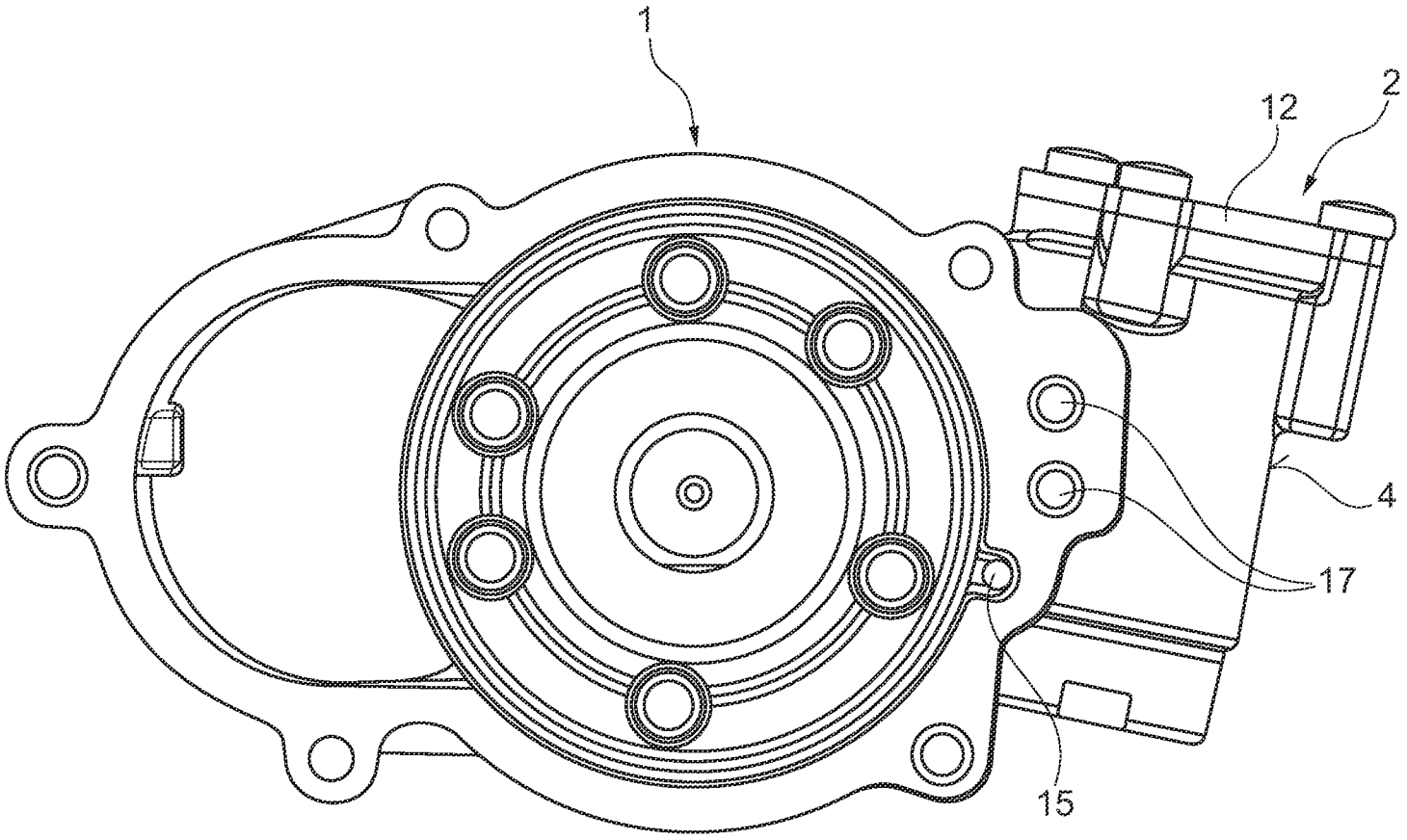
FIG. 2 shows a front view of the cover element with pressure reservoir.
Figure 3:
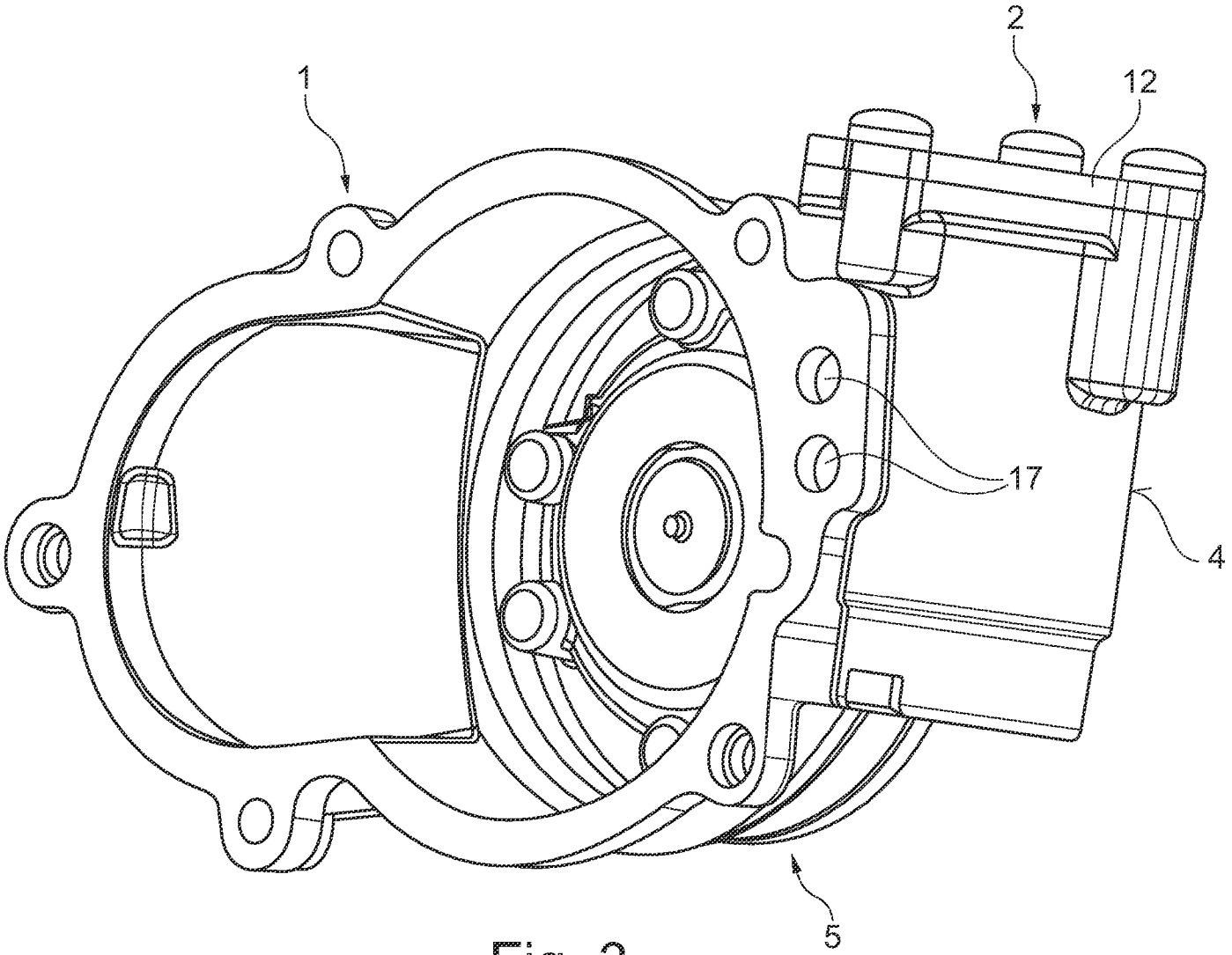
FIG. 3 shows another perspective view of the cover element with pressure reservoir.
Figure 4:
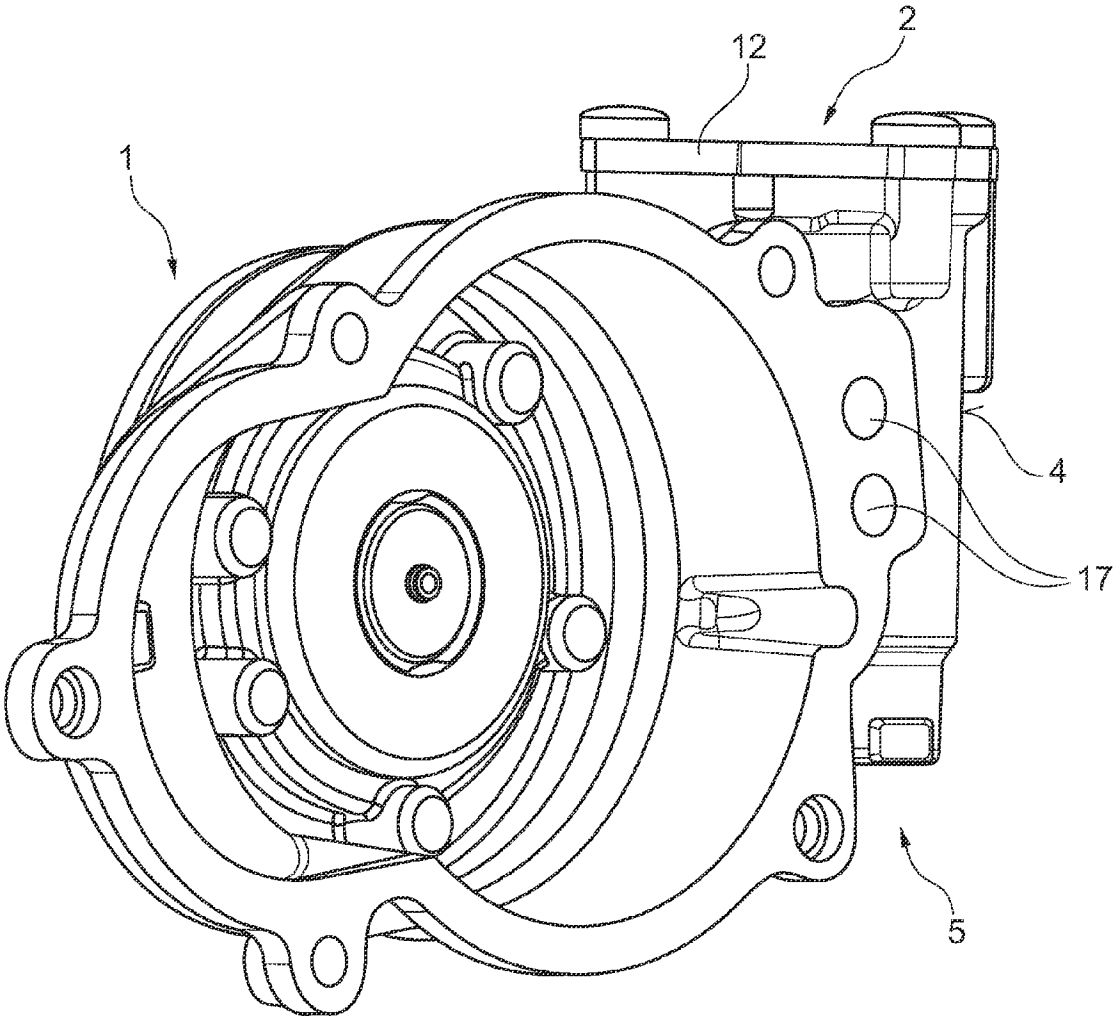
FIG. 4 shows another perspective view of the cover element with pressure reservoir, viewed from another direction.
Figure 5:
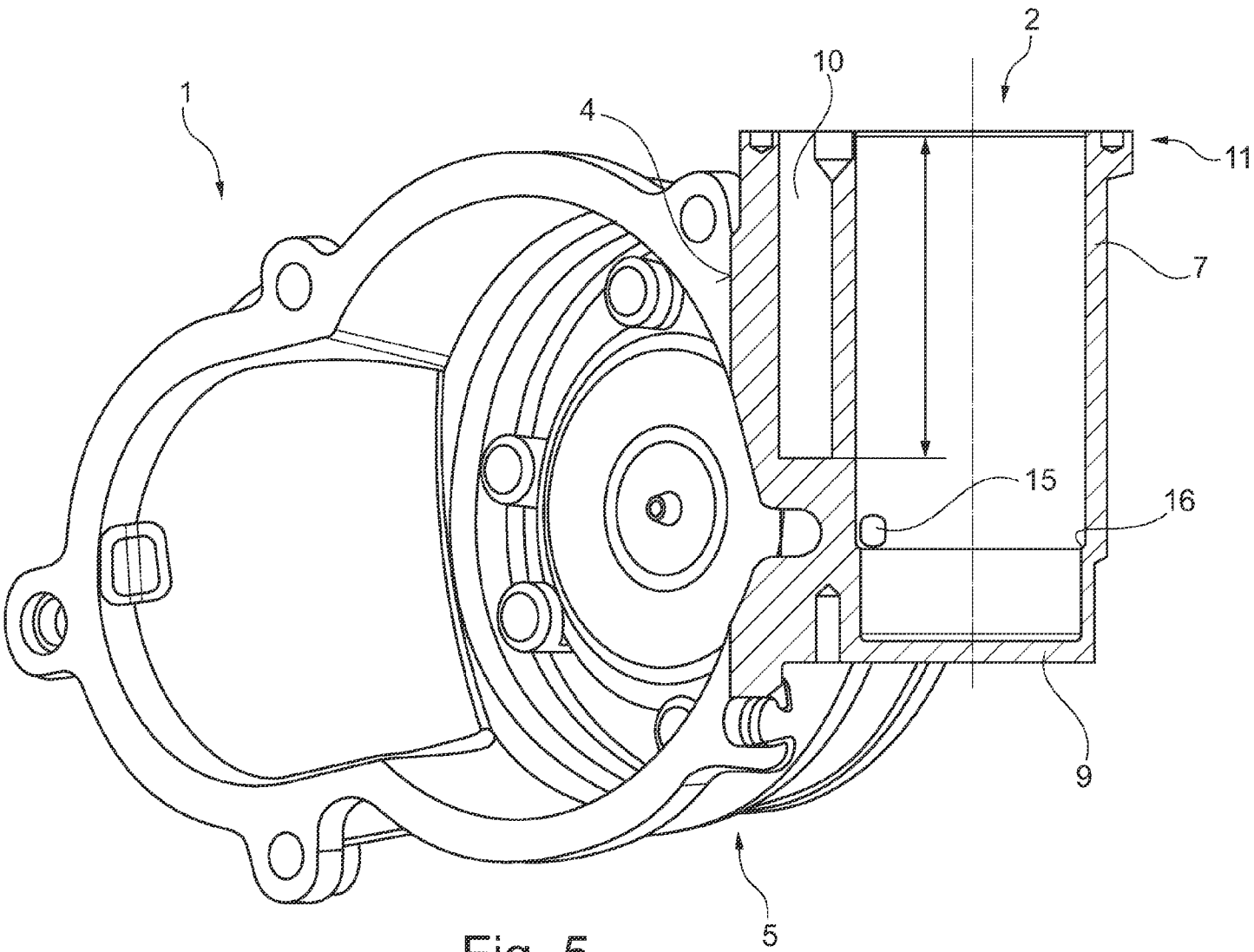
FIG. 5 shows another perspective view of the cover element with pressure reservoir, wherein the pressure reservoir is displayed as cross-section and parts of the pressure reservoir aren't assembled at this stage.
Figure 6:
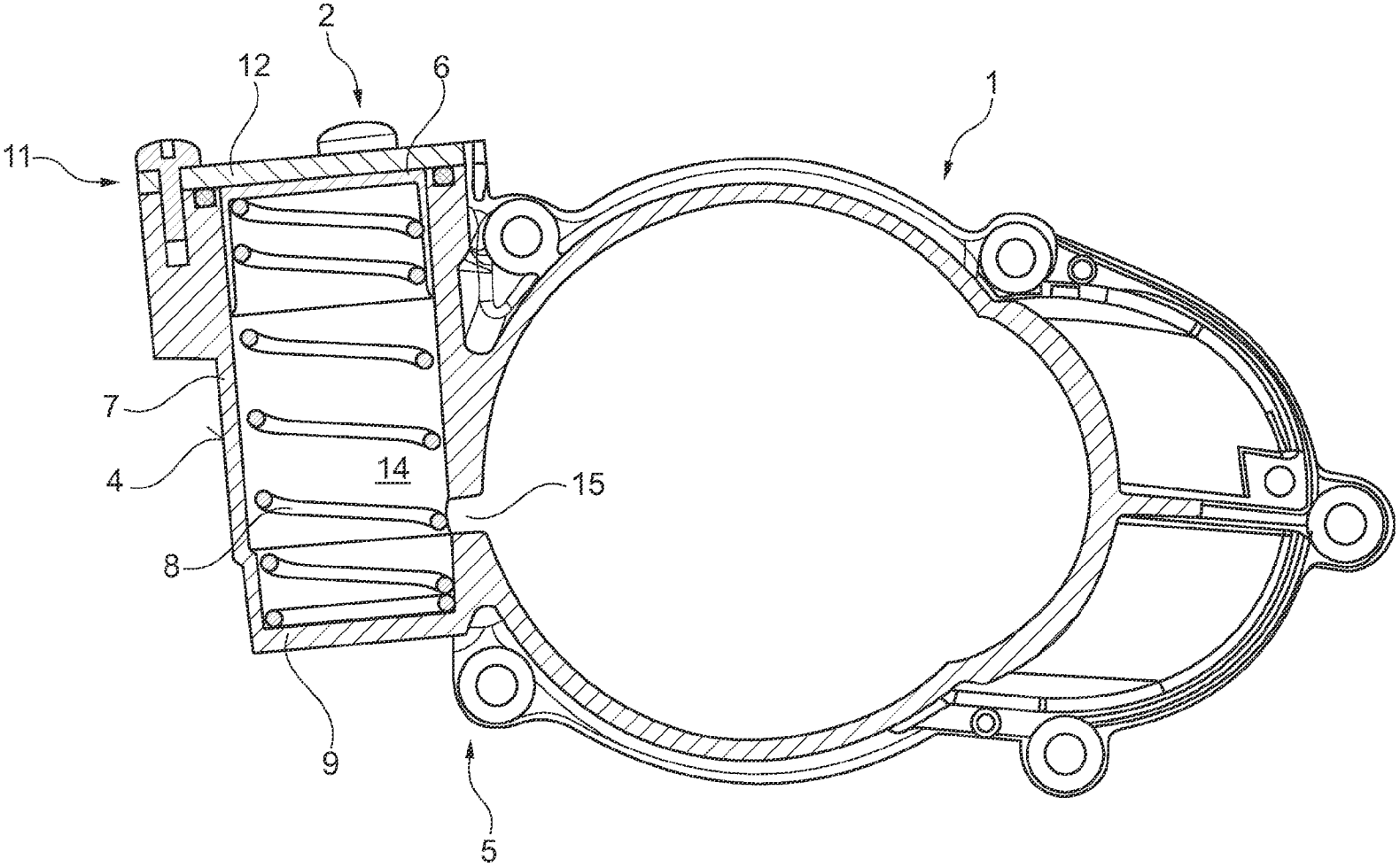
FIG. 6 shows a view opposite to that shown in FIG. 2, wherein the housing element with pressure reservoir is shown in a cut-away view.

In the drawings a device for changing the relative angular position of a camshaft with respect to a crankshaft of an internal combustion engine, in other words, a camshaft adjustment device, is only partly displayed. It is shown a closing cover-like housing element 1, in which control means for controlling the flow of hydraulic oil in order to achieve an adjustment of the relative angular position between crankshaft and camshaft of the internal combustion engine can be housed.

This construction is basically known, wherefore reference is explicitly made to the German patent application DE 39 29 619 A1.

The displayed housing element 1 is mounted to the other assemblies of the camshaft adjustment device by means of a number of bolts. The other assemblies of the camshaft adjustment device have no importance for the present invention and are not displayed for this reason.

In order to constantly provide hydraulic fluid of sufficient pressure, a pressure reservoir 2 is arranged on the housing element 1. The pressure reservoir 2 has a pressure chamber 3, which has a variable volume and so various amounts of hydraulic fluid can be taken in. The pressure reservoir 2 is a piston-cylinder system, in other words, it has a piston 6, which is arranged in a cylinder element 7 and can be moved in a direction of movement V in the cylinder element 7.

The pressure reservoir 2 has a substantially cylindrical basic shape. The piston 6 thereby moves against the force of a spring element 8, which therefore prestresses the piston 6 and builds up the pressure in the pressurized fluid, which is channeled to the pressure reservoir.

It is essential that the pressure reservoir 2 is arranged at the housing element 1 in such a manner that the cylindrical lateral face 4 thereof abuts a lateral portion 5 of the housing element 1. Thereby at least one fluid connection is formed between the housing element 1 and the pressure chamber 3 of the pressure reservoir 2. If elements (for instance the following described connection duct 10) disturb the cylindrical from of the pressure reservoir 2, the defined cylindrical lateral face refers to the cylindrical lateral face of the cylinder, which is defined by the cylinder element 7.

The housing element 1 and the housing 9 of the pressure reservoir 2 are formed in one piece as cast part, preferably as an aluminum pressure cast part. All substantial functional surfaces and flow channels for the pressurized fluid and the venting of the system are integrated in the cast construction in order to reduce mechanical, cutting reworking.

In order to channel pressurized fluid from the housing element 1 to the pressure reservoir 2 and in particular to the pressure chamber 3 of the pressure reservoir 2, a fluid connection duct 10 is provided. It runs parallel to the direction of movement V in the lateral portion of the housing 9 of the pressure reservoir 2. The connection duct 10 has a length L greater than 50 percent of the overall height H of the pressure reservoir 2.

In view of all the accompanying drawings in conjunction with each other it is apparent that pressurized fluid can be channeled by two fluid inlets 17—formed as holes in the connecting wall between the housing element 1 and the pressure reservoir 2—to the connection duct 10.

The pressurized fluid then goes up in the connection duct 10 and reaches the upper axial end portion 11 of the pressure reservoir 2, where a cover element 12 is fixed by bolts. A recess is formed in the cover element 12 and forms a flow path 13, so that pressurized fluid can flow from the connection duct 10 to the pressure chamber 3. When pressurized fluid enters, the piston 6 is pressed down against the force of the spring element 8.

Below the piston 6 is an equalization chamber 14, whose volume is reduced when pressurized fluid is entering the pressure chamber 3. A fluid connection 15 is provided for the venting of the equalization chamber 14.

In order to prevent the windings of the coil element 8 of being driven to its hard stop when the pressure chamber 3 is filled correspondingly with pressurized fluid, a defined stop for the lowest position of the piston 6 is provided in the cylinder element. It is marked by reference character 16. The stop is formed by a radial reduction of the bore diameter of the cylinder element 7 and therefore provides means for limiting the axial movement of the piston 6.

REFERENCE CHARACTER LIST

1 Housing element
2 Pressure reservoir
3 Pressure chamber
4 cylindrical lateral face
5 Lateral portion of the housing element
6 Piston
7 Cylinder element
8 Spring element
9 Housing of the pressure reservoir
10 Fluid connection duct

11 Axial end portion of the pressure reservoir
12 Cover element
13 Flow path
14 Equalization chamber
15 Fluid connection (vent line)
16 Means for limiting the axial movement
17 Fluid inlet
V Direction of movement
L Length of the fluid connection line
H Overall height of the pressure reservoir

What is claimed is:

1. A device for changing a relative angular position of a camshaft with respect to a crankshaft of an internal combustion engine, comprising:

a drive element driven by the crankshaft, wherein the drive element is mounted rotatably about the camshaft, and wherein at least two hydraulic chambers are formed between the drive element and the camshaft, wherein the hydraulic chambers are pressurizable with a pressurized fluid in order to set a defined relative rotational position between the drive element and the camshaft;

a housing element, in which means for controlling the flow of the pressurized fluid are arranged;

a pressure reservoir having a pressure chamber for pressurized fluid, the pressure reservoir being substantially cylindrical and being formed as a piston-cylinder system having a piston arranged movably in a cylinder element, the piston being prestressed in the cylinder element by a spring, the pressure reservoir being arranged on the housing element so that a cylindrical lateral face of the reservoir abuts a lateral portion of the housing element, at least one fluid connection being formed between the housing element and the pressure chamber of the pressure reservoir, wherein the housing element and a housing of the pressure reservoir are formed as a one piece part; and a cover closing an axial end portion of the pressure reservoir, wherein the fluid connection is a fluid connection duct between the lateral portion of the housing element and the pressure chamber of the pressure reservoir, the fluid connection duct running parallel to a direction of movement of the piston of the pressure reservoir to the axial end portion of the pressure reservoir, and wherein the cover has at least one flow path for the flow of pressurized fluid from an end of the fluid connection duct to the pressure chamber.

2. The device as recited in claim 1 wherein the spring is a coil spring.

3. The device as recited in claim 1 wherein the housing element and the housing of the pressure reservoir are formed as a cast part.

4. The device as recited in claim 3 wherein the housing element and the housing of the pressure reservoir are made of a light metal.

5. The device as recited in claim 4 wherein the metal is aluminum.

6. The device as recited in claim 1 wherein the fluid connection is a fluid connection duct between the lateral portion of the housing element and the pressure chamber of the pressure reservoir, the fluid connection duct running parallel to a direction of movement of the piston of the pressure reservoir to an axial end portion of the pressure reservoir.

7. The device as recited in claim 6 wherein a length of the fluid connection duct is 50 percent of the overall height of the pressure reservoir.

8. The device as recited in claim 1 wherein the piston delimits the pressure chamber of the pressure reservoir to an equalization chamber of the pressure reservoir, the fluid connection being formed between the housing element and the equalization chamber.

9. The device as recited in claim 1 further comprising a limiter for limiting the axial movement of the piston in the cylinder element.

10. The device as recited in claim 1 wherein the housing of the pressure reservoir includes an upper axial end portion closed by a cover element.

11. The device as recited in claim 1 wherein an outer surface of the housing of the pressure reservoir extends circumferentially into the cylindrical lateral face abutting a lateral portion of the housing element.

12. The device as recited in claim 1 wherein a center axis of the pressure reservoir is radially offset from a center axis of the housing element.

13. The device as recited in claim 1 wherein the piston is movable in a tangential direction with respect to the housing element.

* * * * *